US007780554B1

(12) United States Patent
Sanford

(10) Patent No.: US 7,780,554 B1
(45) **Date of Patent: *Aug. 24, 2010**

(54) EXPANDABLE ARROW BROADHEAD FOR ATTACHMENT TO ONE END OF AN ARROW SHAFT

(75) Inventor: Chris G. Sanford, Molt, MT (US)

(73) Assignee: Bear Archery, Inc., Evansville, IN (US)

( * ) Notice: Subject to any disclaimer, the term of this patent is extended or adjusted under 35 U.S.C. 154(b) by 658 days.

This patent is subject to a terminal disclaimer.

(21) Appl. No.: 11/809,653

(22) Filed: Jun. 1, 2007

Related U.S. Application Data

(63) Continuation of application No. 11/410,771, filed on Apr. 24, 2006, now Pat. No. 7,226,375.

(51) Int. Cl.
*F42B 6/08* (2006.01)

(52) U.S. Cl. ..... 473/583

(58) Field of Classification Search ..... 473/578, 473/583, 584

See application file for complete search history.

(56) References Cited

U.S. PATENT DOCUMENTS

| | | | |
|---|---|---|---|
| 2,859,970 | A | 11/1958 | Doonan |
| 2,993,697 | A | 7/1961 | Urban |
| 3,014,305 | A | 12/1961 | Yurchich |
| 3,578,328 | A | 5/1971 | Rickey |
| 4,099,720 | A | 7/1978 | Zeren |
| 5,100,143 | A | 3/1992 | Puckett et al. |
| 5,322,297 | A | 6/1994 | Smith |
| 5,941,784 | A | 8/1999 | Mizek |
| 6,200,237 | B1 | 3/2001 | Barrie |
| 6,258,000 | B1 | 7/2001 | Liechty, II |
| 6,270,435 | B1 | 8/2001 | Sodaro |
| 6,517,454 | B2 | 2/2003 | Barrie et al. |
| 6,626,776 | B2 | 9/2003 | Barrie et al. |
| 6,669,586 | B2 | 12/2003 | Barrie et al. |
| 6,935,976 | B1 | 8/2005 | Grace et al. |
| 7,226,375 | B1 * | 6/2007 | Sanford ..... 473/583 |

* cited by examiner

*Primary Examiner*—John Ricci
(74) *Attorney, Agent, or Firm*—Woodard, Emhardt, Moriarty, McNett & Henry LLP

(57) ABSTRACT

An expandable arrow broadhead used for releasable attachment to one end of a hollow arrow shaft. The broadhead includes a sliding shaft with a pointed tip and tip base having two or more of cutting blades mounted thereon. Each of the blades includes an outer cutting edge and an inner edge. A portion of the sliding shaft is slidably received inside a hollow collar. The collar is attached to a sliding shaft housing. The sliding shaft housing is attached to an arrow shaft insert. The arrow shaft insert is adapted for receipt inside one end of the arrow shaft. In a retracted position, the blades are disposed next to and parallel to the length of the sliding shaft. When the pointed tip engages a target, the sliding shaft moves inwardly and rearwardly sliding inside the collar and inside a sliding shaft bore hole in the sliding shaft housing. As the sliding shaft moves rearwardly, a beveled cam surface of the blades engages a portion of the collar, which moves the blades outwardly into an extended position.

15 Claims, 4 Drawing Sheets

FIG. 4
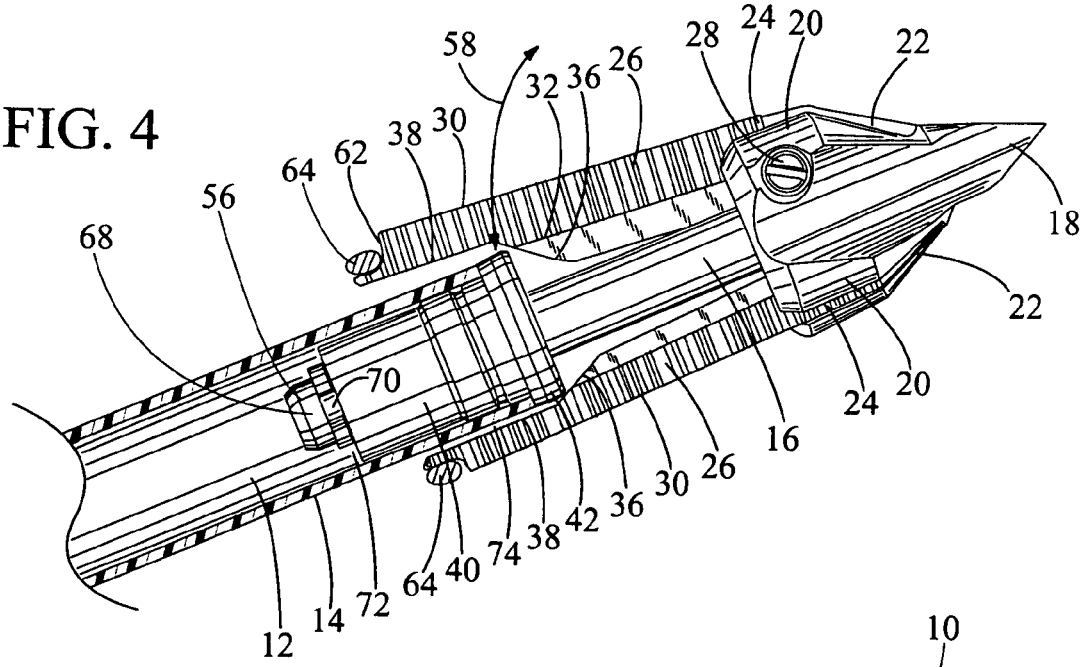
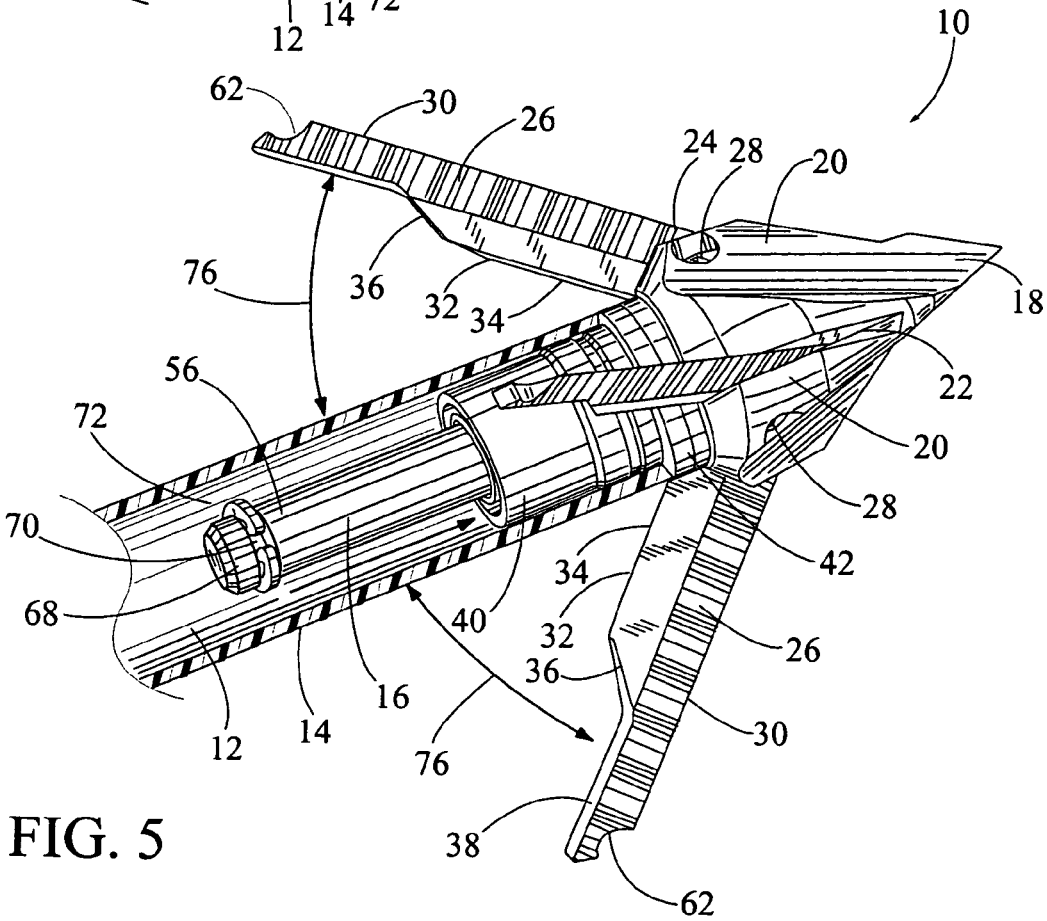
FIG. 5

EXPANDABLE ARROW BROADHEAD FOR ATTACHMENT TO ONE END OF AN ARROW SHAFT

This application is a Continuation patent application of an application filed on Apr. 24, 2006, Ser. No. 11/410,771 now U.S. Pat. No. 7,226,375, by the subject inventor and having a title of "EXPANDABLE ARROW BROADHEAD FOR ATTACHMENT TO ONE END OF AN ARROW SHAFT". The inventor claims the benefit of the earlier filed application.

BACKGROUND OF THE INVENTION (a) Field of the Invention

This invention relates broadly to an expandable arrow broadhead and more particularly, but not by way of limitation, to an arrow broadhead having a sliding shaft for extending outwardly at least two blades upon impact on a target.

(b) Discussion of Prior Art

Heretofore, there have been a number of arrow broadheads having blades that extend outwardly when contacting a surface of a target. U.S. Pat. No. 6,935,976 to Grace, Jr. et al., discloses a mechanical broadhead having blades, mounted in longitudinal channels in a ferrule, that slide outwardly on a camming surface formed in an inward edge of each blade. U.S. Pat. No. 6,270,435 to Sodaro illustrates an arrowhead having spring loaded blades that expand outwardly upon contact with a target. U.S. Pat. Nos. 6,910,979, 6,626,776 and 6,517,454 to Barrie et al. disclose blades having longitudinal grooves in the blades and a camming member for extending the blades outwardly upon target impact. U.S. Pat. Nos. 6,669,586 and 6,200,237 to Bathe disclose blades mounted on a sliding body mounted on a length of the broadhead. As the sliding body moves rearwardly upon target impact, the blades engage a camming surface and are moved outwardly in an extended position.

None of the above mentioned prior art broadhead patents particularly disclose or teach the structure and function of an arrow broadhead having a sliding shaft with pointed tip and cutting blades attached. The sliding shaft is designed to move rearwardly upon target impact with the blades expanding outwardly upon engaging a threaded collar attached to a sliding shaft housing or attached directly to an arrow shaft insert mounted in one end of a hollow arrow shaft.

SUMMARY OF THE INVENTION

In view of the foregoing, it is a primary objective of the subject invention to provide an arrow broadhead that maintains cutting blades in a retracted folded position and next to a sliding shaft for little or no deflection during arrow flight or at target contact. The blades expand outwardly from the folded position into an extend position upon target contact.

Another object of the arrow broadhead is the expanded blades provide for a large cutting diameter to cause increased hemoraging and a quick and more humane kill when hunting deer, elk and other animals.

Still another object of the invention is the arrow broadhead can be inserted in a press fit or threaded into an end of different size arrow shaft inserts or mounted on a ferrule attached to the end of the arrow shaft.

Yet another object of the arrow broadhead is a pointed tip is formed at one end of the sliding shaft. Therefore, the moment the pointed tip contacts the target, the sliding shaft moves rearwardly moving the cutting blades into the extended position.

The subject arrow broadhead includes a sliding shaft with a pointed tip formed in a front portion of the shaft. The pointed tip is tapered rearwardly and outwardly forming a tip base. The tip base includes grooves formed therein and parallel to a length of the sliding shaft. The grooves are used for receiving a pivot end of two or more of cutting blades. The pivot end of the cutting blades is pinned to sides of the grooves. Each of the blades includes an outer cutting edge and an inner edge. The inner edge of the blades includes a beveled cam surface disposed next to a portion of the length of the sliding shaft. A portion of the sliding shaft is slidably received inside a threaded collar. The collar is attached to a sliding shaft housing or the threaded collar is attached directly to an arrow shaft insert. The arrow shaft insert is adapted for receipt inside one end of a hollow arrow shaft. In a retracted position, the blades are disposed next to and parallel to the length of the sliding shaft. When the pointed tip engages a target upon impact, the sliding shaft moves rearwardly sliding inside the threaded collar. As the sliding shaft moves rearwardly, the beveled cam surface engages a portion of the threaded collar and moves the blades outwardly into an extended position.

These and other objects of the present invention will become apparent to those familiar with the use of arrow broadheads for hunting when reviewing the following detailed description, showing novel construction, combination, and elements as described, and more particularly defined by the claims, it being understood that changes in the embodiments to the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for it's practical application and in which:

FIG. 4 is a side view of the arrow broadhead shown in FIG. 3 with the sliding shaft and illustrating cutting blades in a retracted folded position during arrow flight.

FIG. 5 is a perspective view of the arrow broadhead shown in FIG. 4 with the sliding shaft moved rearwardly. The cutting blades are shown pivoted outwardly into an extended position.

DETAILED DESCRIPTION OF THE PREFERRED EMBODIMENTS

Figure 1:
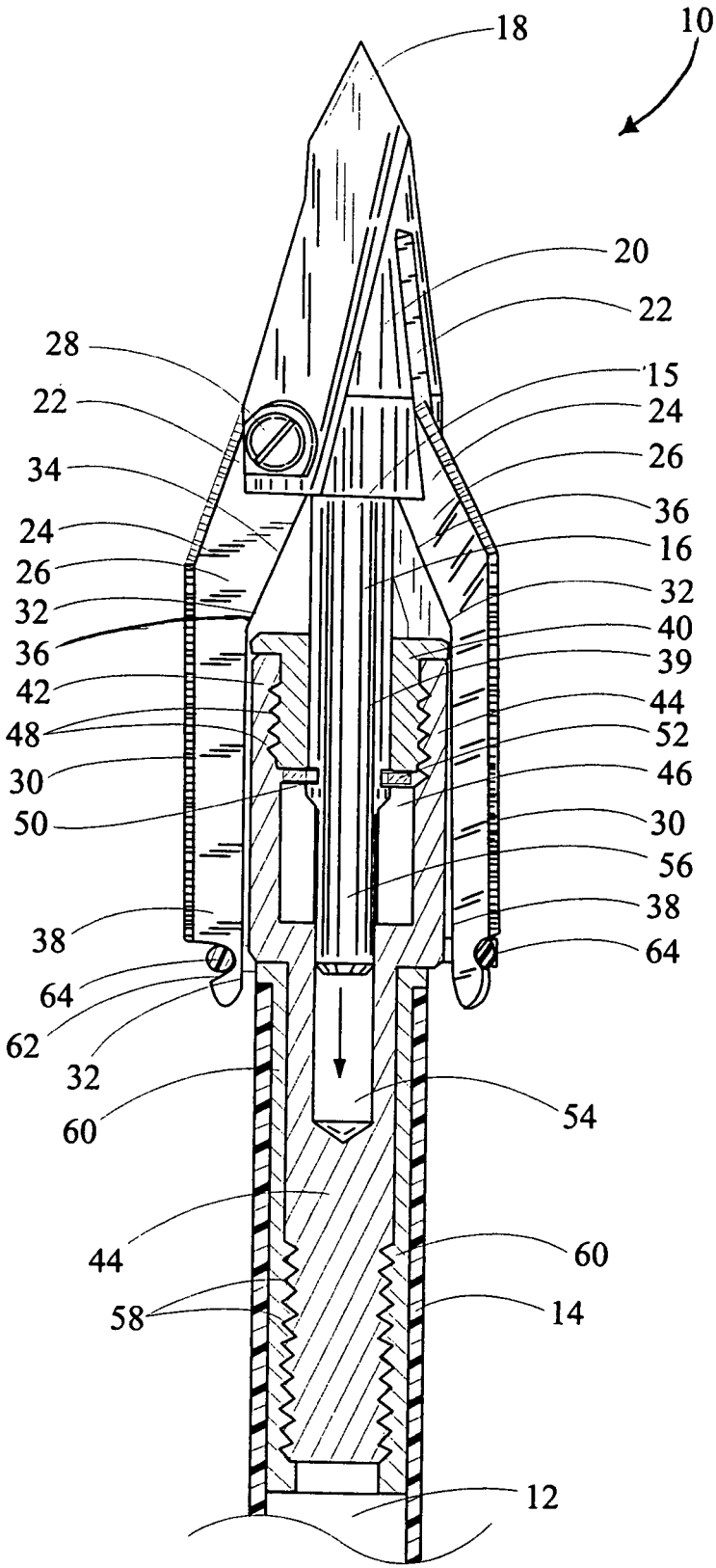
FIG. 1 is a side view of a primary embodiment of the subject arrow broadhead illustrating a sliding shaft housing for receiving a portion of a sliding shaft. A threaded lower end of the sliding shaft housing is attached to an arrow shaft insert in a hollow arrow shaft.

In FIG. 1, a side view of a primary embodiment of the subject arrow broadhead is shown and having general reference numeral 10. The arrow broadhead 10 is adapted from mounting to an open end 12 of a hollow arrow shaft 14. A portion of the arrow shaft 14 is shown in cross section.

The arrow broadhead 10 includes a sliding shaft 16 with a pointed tip 18 formed in a front portion 15 of the shaft 16. The pointed tip 18 is tapered rearwardly and outwardly forming a tip base 20. The tip base 20 includes grooves 22 formed therein and parallel to a length of the sliding shaft 16. The grooves 22 are used for receiving a pivot end 24 of two or more of cutting blades 26 equally spaced around the circumference of the tip base 20. In this drawing, two of the cutting blades 26 can be seen. In FIG. 5, three of the cutting blades 26 are shown and equally spaced around the tip base 20. The pivot end 24 of the cutting blades 26 is attached to the sides of the grooves 22 using pivot pins 28.

Each of the cutting blades 26 include an outer cutting edge 30 and an inner edge 32. The inner edge 32 of the blades 26 is disposed next to a portion of a length of the sliding shaft 16. Also, the inner edge 32 of the blades 26 is characterized by having a forward portion 34 with a beveled cam surface 36 and a rearward portion 38. The rearward portion 38 is also parallel to the length of the sliding shaft 16. A middle portion 39 of the sliding shaft 16 is slidably received inside and through a hollow collar 40. The exterior of the collar 40 is threaded into a top portion 42 of a sliding shaft housing 44.

The sliding shaft housing 44 includes a collar bore hole 46 with an threaded upper end 48. The threaded upper end 48 of the collar bore hole 46 is used for threading the hollow collar 40 thereon. In the lower end of the middle portion 39 of the shaft 16 is an annular groove 50 for receiving a ring keeper 52. The ring keeper 52 prevents the sliding shaft 16 from being removed from inside the threaded hollow collar 40

The sliding shaft housing 44 also includes a smaller, sliding shaft lower bore hole 54 for receiving a lower end portion 56 of the sliding shaft 16. A threaded lower end 58 of the sliding shaft housing 44 is used for attachment to a first arrow shaft insert 60 in the hollow arrow shaft 14. Typical, hunting arrows include the arrow shaft insert 60, therefore, the arrow broadhead 10 can be easily attached to different types of arrows by merely threading the sliding shaft housing 44 into the arrow shaft insert 60 as shown.

Figure 2:
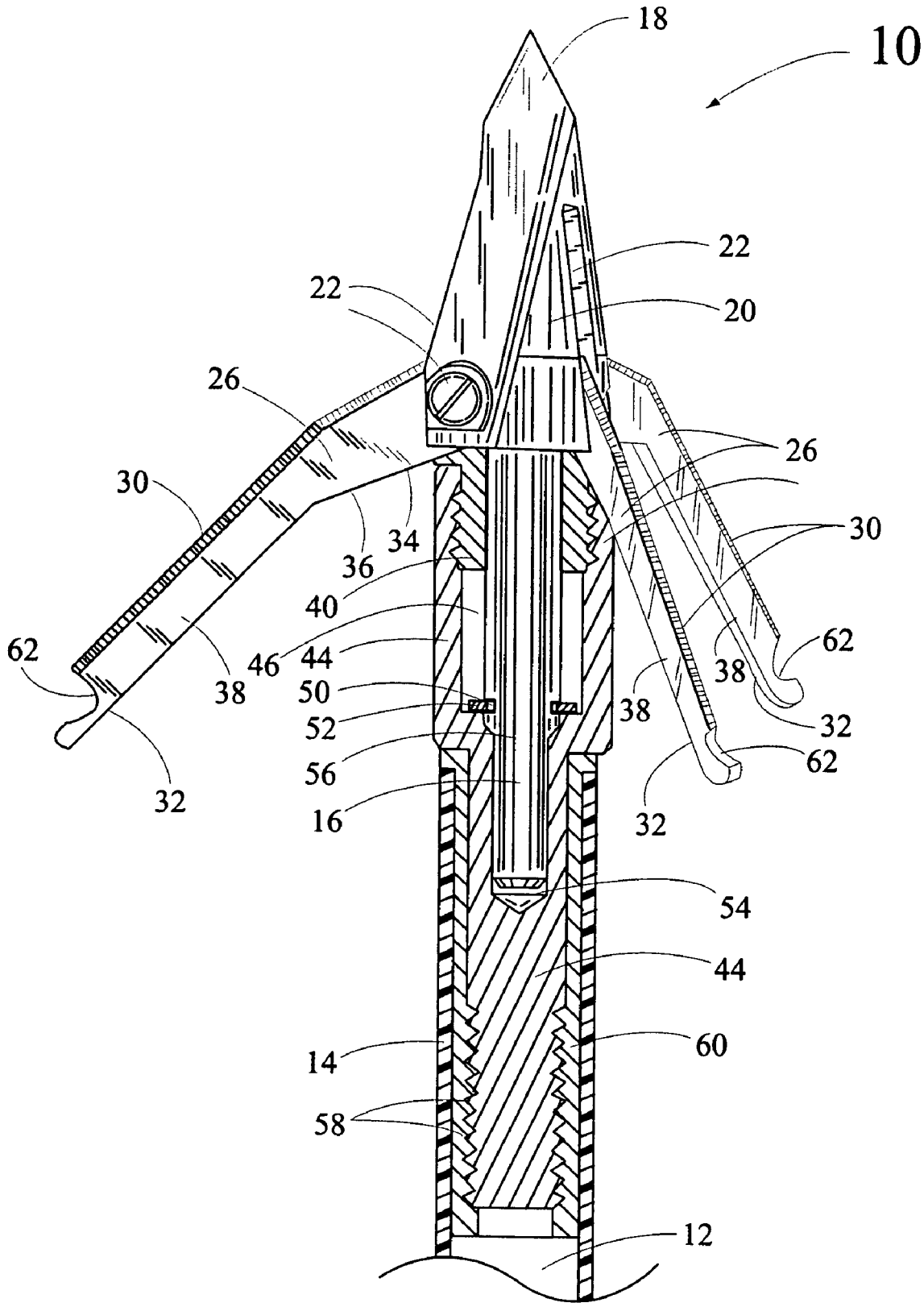
FIG. 2 is another side view of the arrow broadhead shown in FIG. 1 with the sliding shaft moved inwardly into a sliding shaft bore hole in the sliding shaft housing. Also shown in this drawing is the beveled cam surface of the cutting blades engaging the side of a hollow collar and moving the cutting blades outwardly into an extended position.
Figure 3:
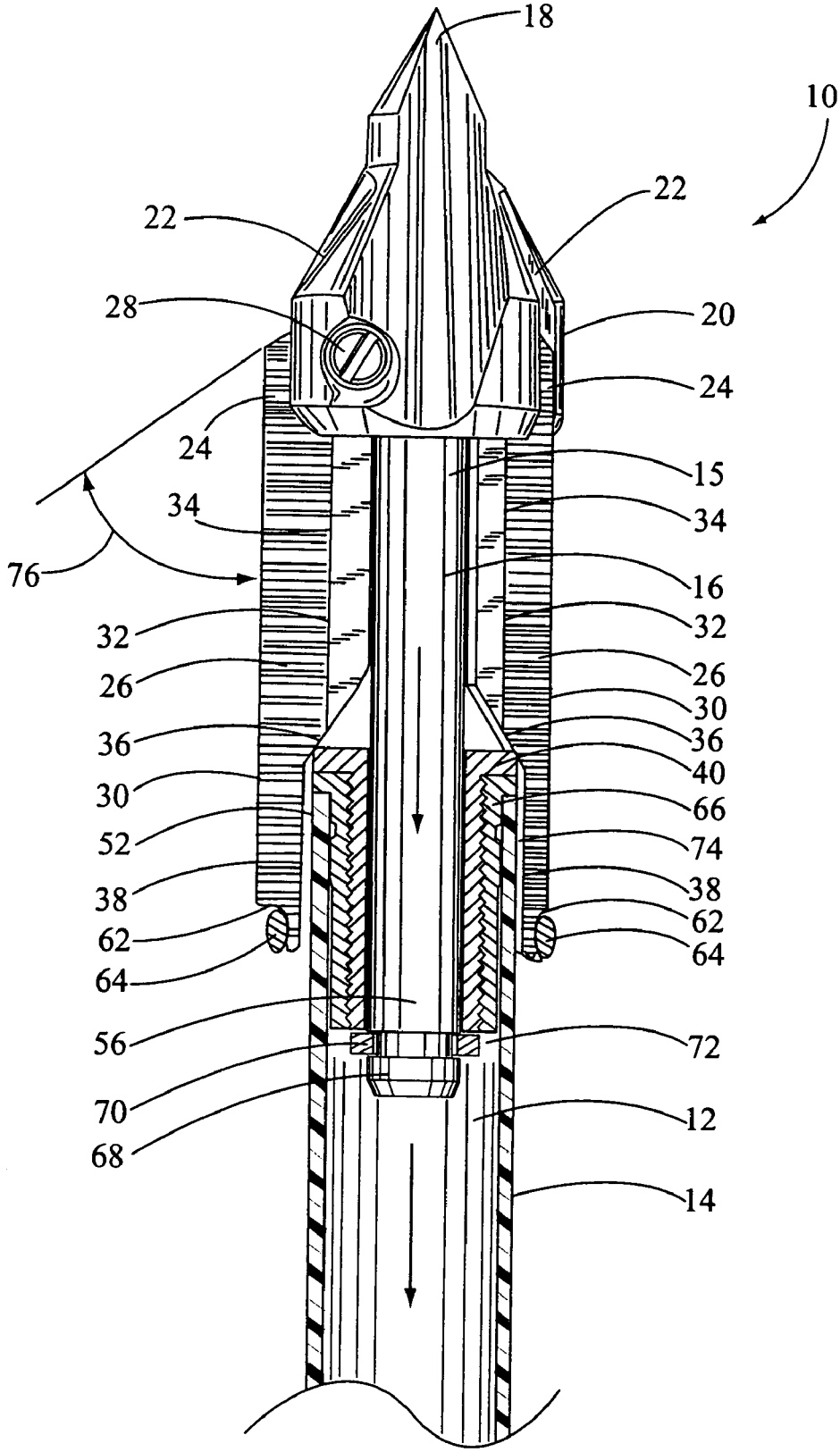
FIG. 3 is a side view of another embodiment of the subject arrow broadhead with a sliding shaft and attached to an arrow shaft insert in one end of a hollow arrow shaft. The arrow shaft insert and the end of the arrow shaft are shown in cross section.

The outer cutting edge 30 of the blades 26 includes an outer notch 62 for receiving a portion of a rubber band 64 or like retaining device for holding the blades 26 in a folded, retracted position, as shown in FIGS. 1, 3 and 4. Also, the band 64 helps prevent the sliding shaft 16 from sliding rearwardly and inwardly in the collar 40 during the flight of the arrow and prematurely extending the blades 26 outwardly in an extended position as shown in FIGS. 2 and 5. The band 64 is shown in cross section.

In FIG. 2, another side view of the arrow broadhead 10 is shown with the lower end portion 56 of the sliding shaft 16 moved inwardly into the sliding shaft lower bore hole 54. Also shown in this drawing is the beveled cam surface 36 of the cutting blades 26 engaging the side of the hollow collar 40 and moving the cutting blades outwardly into an extended position.

In FIG. 3, another embodiment of the invention is shown and without using the sliding shaft housing 44, as shown in FIGS. 1 and 2. In this example, the lower end portion 56 of the sliding shaft 16 is slidably received inside and through the hollow collar 40. The exterior of the hollow collar 40 is either threaded or engaged in a press fit inside a second arrow shaft insert 66, which is similar to the first arrow shaft insert 60 as shown in FIGS. 1 and 2.

The hollow collar 40 and the second arrow shaft insert 66 are shown in cross section in this drawing. The arrow shaft insert 66 is adapted for receipt inside the open end 12 of the hollow arrow shaft 14. The collar 40 and insert 66 can be of various lengths and sizes for attachment to different types and sizes of hollow arrow shafts.

A bottom end 68 of the lower end portion 56 of the shaft 16 includes an annular groove 70 for receiving a portion of a ring keeper 72 therein. The ring keeper 72 is used for holding the shaft 16 inside collar 40.

In a retracted folded position, the blades 26 of the arrow broadhead 10 are disposed next to and parallel to the length of the sliding shaft 16. It should be noted the rearward portion 38 of the inner edge 32 of the cutting blades 26 includes an inner notch 74 therein. The inner notch 74 allows the rearward portion 38 of the blades to rest next to a side of the hollow collar 40 and a side of the arrow shaft 14.

In FIG. 4, a side view of the arrow broadhead 10 is shown during arrow flight. In this drawing, the blades 26 are held in a retracted position by the rubber band 64 for reducing air resistance during flight. Upon impact, the force against the shaft 16 releases the rubber band 64 from the outer notch 62 of the blades 26 as the sliding shaft 16 moves rearwardly through the collar 40.

When the pointed tip 18 engages a target upon impact, the sliding shaft 16 moves rearwardly sliding inside and through the collar 40 and into a portion of the hollow arrow shaft 14. As the sliding shaft 16 moves rearwardly, the beveled cam surface 36 engages a portion of an exterior side of the hollow collar 40 and moves the blades 26 outwardly into an extended position.

In FIG. 5, a perspective view of the arrow broadhead 10 is shown with the sliding shaft 16 moved rearwardly upon target contact. The cutting blades 26 are shown pivoted outwardly at an angle, shown as arrow 76, in a range of 30 to 60 degrees from the length of the sliding shaft 16 and into an extended position. In this drawing, the lower end portion 56 and the ring keeper 72 of the sliding shaft 16 are shown extending inside a portion of the hollow arrow shaft 14.

While the invention has been shown in detail with reference to the preferred embodiments and modifications thereof, it should be understood by those skilled in the art that equivalent changes in form and detail may be made without departing from the true spirit and scope of the invention as claimed except as precluded by the prior art.

The embodiments of the invention for which an exclusive privilege and property right are claimed are defined as follows:

1. An arrow broadhead adapted for attaching to an open end of a hollow arrow shaft, the broadhead also adapted for moving from a retracted position during arrow flight to an extended position when contacting a target, the broadhead comprising:

a sliding shaft having a pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface;

a hollow collar for receiving a portion of said sliding shaft therethrough; and a sliding shaft housing having a bore hole therein and a lower end, said hollow collar attached to a side of said bore hole, a lower end portion of said sliding shaft received in said bore hole, the lower end of said sliding shaft housing adapted for receipt inside the open end of the hollow arrow shaft;

whereby, when said pointed tip contacts the target, said sliding shaft moves inwardly through said hollow collar and into said bore hole and the beveled cam surface of said blades contacts a portion of a side of said hollow collar and moves said blades outwardly from a folded, retracted position into an extended position; and, wherein said bore hole of said sliding shaft housing includes a threaded upper end in a collar bore hole and a smaller sliding shaft bore hole below said collar bore hole, said hollow collar attached to the threaded upper end of said sliding shaft housing, a lower end portion of said sliding shaft received in said sliding shaft bore hole.

2. The broadhead as described in claim 1 further including a round hollow arrow shaft insert adapted for receipt in the open end of the arrow shaft, the threaded lower end of said sliding shaft housing attached to said arrow shaft insert.

3. The broadhead as described in claim 1 further including three cutting blades equally spaced around a circumference of said tip base and pinned inside grooves in the side of said tip base.

4. The broadhead as described in claim 1 further including a blade retaining band received in an outer notch in said blades, said band for holding said blades in a folded, retracted position during arrow flight.

5. The broadhead as described in claim 1 wherein a portion of said sliding shaft includes an annular groove therein for receiving a ring keeper, said ring keeper preventing said sliding shaft from being removed from said hollow collar.

6. An arrow broadhead adapted for attaching to an open end of a hollow arrow shaft, the broadhead also adapted for moving from a retracted position during arrow flight to an extended position when contacting a target, the broadhead comprising:

a sliding shaft also having a pointed tip, said pointed tip disposed in a front portion of said shaft, said pointed tip tapered rearwardly and outwardly forming a tip base, said tip base having grooves formed therein and parallel to a length of said sliding shaft;

at least two cutting blades, said grooves in said tip base used for receiving a pivot end of said cutting blades, the pivot end of said cutting blades pinned to sides of said grooves, said blades including an outer cutting edge and an inner edge, the inner edge of said blades including a beveled cam surface;

a hollow collar for receiving a portion of said sliding shaft therethrough; and a sliding shaft housing having a collar bore hole, a sliding shaft lower bore hole below said collar bore hole and an exterior lower end, said hollow collar attached to an upper end of said sliding shaft housing, a lower end portion of said sliding shaft received in said collar bore hole and said sliding shaft lower bore hole, the lower end of said sliding shaft housing adapted for receipt inside the open end of the hollow arrow shaft;

whereby, when said pointed tip contacts a target, said sliding shaft moves inwardly through said hollow collar and into said sliding shaft lower bore hole and said beveled cam surface contacts a portion of a side of said hollow collar and moves said blades outwardly from a folded, retracted position into an extended position.

7. The broadhead as described in claim 6 further including a round hollow arrow shaft insert adapted for receipt in the open end of the arrow shaft, said exterior threaded lower end of said sliding shaft housing attached to said arrow shaft insert.

8. The broadhead as described in claim 6 further including three cutting blades equally spaced around a circumference of said tip base and pinned inside grooves in the side of said tip base.

9. The broadhead as described in claim 8 further including a blade retaining band received in an outer notch in said three blades, said band for holding said blades in a folded, retracted position during arrow flight.

10. The broadhead as described in claim 6 wherein a portion of said sliding shall includes an annular groove therein for receiving a ring keeper, said ring keeper preventing said sliding shaft from being removed from said hollow collar.

11. An arrow broadhead adapted for attaching to an open end of a hollow arrow shaft, the broadhead also adapted for moving from a folded, retracted position to an extended position when contacting a target, the broadhead comprising:

a sliding shaft having a pointed tip, said pointed tip disposed in a front portion of said shaft, said pointed tip tapered rearwardly and outwardly forming a tip base;

at least two cutting blades pivotally attached to said tip base, said blades including an outer cutting edge and an inner edge, the inner edge of said blades including a beveled cam surface; and an arrow shaft insert adapted for receipt in the open end of the arrow shaft;

a hollow collar received inside said shaft insert and adapted to extend into and to be received inside the open end of the hollow arrow shaft within said shaft insert, a lower end portion of said sliding shaft slidably received inside said collar, whereby, when said pointed tip contacts the target, said sliding shaft moves inwardly through said hollow collar and the beveled cam surface of said blades contacts a portion of a side of said hollow collar, the beveled cam surface moving said blades outwardly from the folded, retracted position next to a length of said shaft into the extended position.

12. The broadhead as described in claim 11 further including three cutting blades equally spaced around a circumference of said tip base and pinned thereto.

13. The broadhead as described in claim 11 further including a blade retaining means received on said blades for holding said blades in a folded, retracted position during arrow flight.

14. The broadhead as described in claim 13 wherein said blade retaining means is a flexible band received around a rearward portion of said blades.

15. The broadhead as described in claim 11 wherein a rear portion of said sliding shaft includes an annular groove therein for receiving a ring keeper, said ring keeper preventing said sliding shaft from being removed from said collar.

* * * * *